United States Patent [19]

Kaltmann et al.

[11] Patent Number: 4,867,065

[45] Date of Patent: Sep. 19, 1989

[54] TRAINING CARTRIDGE

[75] Inventors: Hans-Joachim Kaltmann, Augustastrasse; Horst Kantner, Kanzlerstrasse, both of Fed. Rep. of Germany

[73] Assignee: Rheinmetal GmbH, Düsseldorf, Fed. Rep. of Germany

[21] Appl. No.: 244,408

[22] Filed: Sep. 14, 1988

[30] Foreign Application Priority Data

Sep. 19, 1987 [DE] Fed. Rep. of Germany ..... 3731569

[51] Int. Cl.[4] ..... F42B 8/00

[52] U.S. Cl. ..... 102/444

[58] Field of Search ..... 102/444, 446, 447, 530, 102/531

[56] References Cited

U.S. PATENT DOCUMENTS

| | | | |
|---|---|---|---|
| 812,156 | 2/1906 | Sparre | 102/530 |
| 2,918,868 | 12/1959 | Ringdal | 102/530 |
| 3,136,052 | 6/1964 | Pickart | 102/530 |
| 3,672,301 | 6/1972 | Abbott | 102/530 |
| 3,882,778 | 5/1975 | Gawlick | 102/530 |
| 4,157,684 | 6/1979 | Clausser | 102/444 |
| 4,508,034 | 4/1985 | Jensen et al. . | |
| 4,546,704 | 10/1985 | Ballreich et al. . | |
| 4,593,622 | 6/1986 | Fibranz | 102/530 |

FOREIGN PATENT DOCUMENTS

| | | | |
|---|---|---|---|
| 186559 | 8/1954 | Austria . | |
| 350941 | 6/1979 | Austria . | |
| 0056075 | 7/1982 | European Pat. Off. . | |
| 68733 | 7/1892 | Fed. Rep. of Germany . | |
| 1082162 | 5/1960 | Fed. Rep. of Germany | 102/530 |
| 1298018 | 6/1969 | Fed. Rep. of Germany . | |
| 3048599 | 7/1982 | Fed. Rep. of Germany | 102/444 |
| 3238268 | 4/1984 | Fed. Rep. of Germany . | |
| 3238269 | 5/1986 | Fed. Rep. of Germany . | |
| 92913 | 10/1986 | Fed. Rep. of Germany . | |
| 1132315 | 3/1957 | France . | |
| 1359826 | 3/1964 | France . | |
| 1373432 | 8/1964 | France . | |
| 2394779 | 1/1972 | France . | |
| 277762 | 9/1927 | United Kingdom | 102/530 |
| 1601661 | 11/1981 | United Kingdom . | |

*Primary Examiner*—Harold J. Tudor

*Attorney, Agent, or Firm*—Spencer & Frank

[57] ABSTRACT

A training cartridge including a training charge contained in a cartridge case. The training cartridge is for use in externally driven automatic weapons firing at high cadences and is to be manufactured easily and economically. This is accomplished by a cylindrical plastic insert having a central bore which accommodates the practice charge. It is introduced into a central case and is fixed therein by means of an externally applied rolled section.

13 Claims, 1 Drawing Sheet

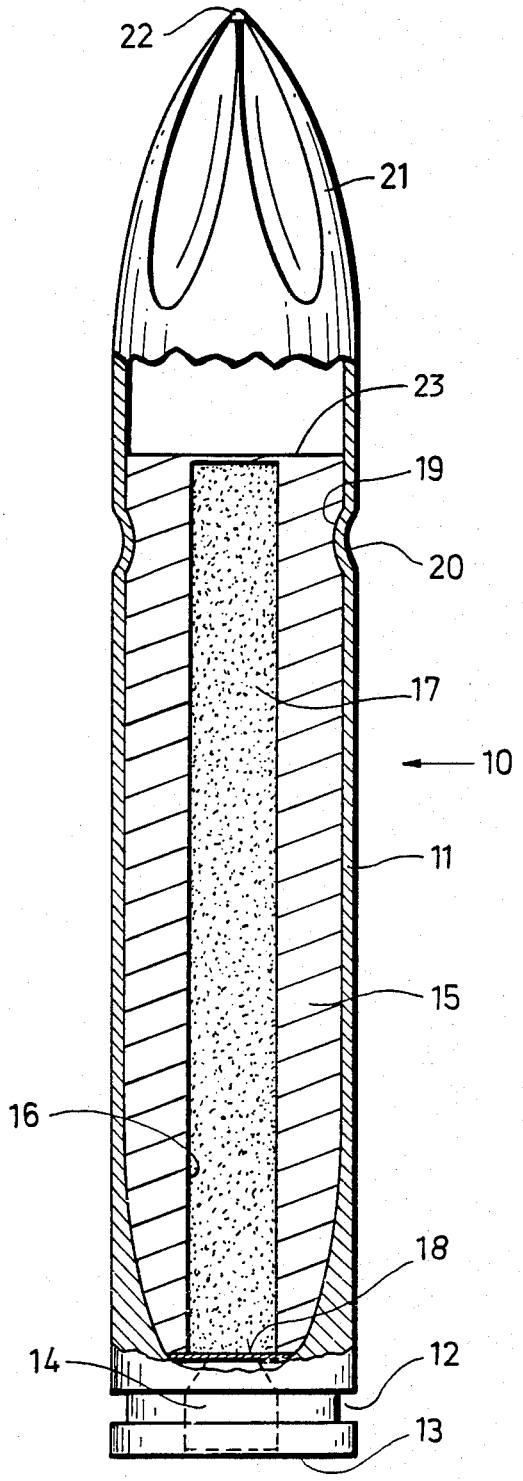
22
21
23
19
20
17
10
11
15
16
18
14
12
13

TRAINING CARTRIDGE

BACKGROUND OF THE INVENTION

The present invention relates to a training cartridge including a training or practice charge contained in a cartridge case.

One type of training cartridge is disclosed, for example, in German Patent No. 3,238,268 which corresponds to U.S. Pat. No. 4,508,036 issued April 2nd, 1985. This training cartridge contains a plastic projectile or projectile simulation and includes a plastic insert which projects far beyond the front of the cartridge case. It also extends to the bottom of the case. The case has different diameters throughout its length. The case further has different wall thicknesses and a propelling charge powder chamber in its interior which is almost as large as the volume of the cartridge case. Two-thirds of its volume is filled approximately with loosely poured-in propelling charge powder.

A disadvantage with this type of training cartridge is that there exists a danger, during manufacturing, that propelling charge powder will fall out of the plastic insert. The reason for this danger is that until the insert, which has a complicated shape, is given its final bottle-type configuration by constricting the neck of the case, the insert remains open. Since the propelling charge powder does not completely fill the powder chamber, there also exists the danger of misfiring when the gun is fired in a downward orientation.

It is an object of the present invention to provide a training cartridge, particularly for externally driven automatic weapons, e.g. of 35mm caliber, which fire at high cadences, with such training cartridge being manufactured easily and economically while avoiding the above-described dangerous drawbacks.

SUMMARY OF THE INVENTION

This object and others to become apparent as the specification progresses, are accomplished by the invention, by a training cartridge which comprises an essentially cylindrical cartridge case having a front end and a closed bottom end and having an essentially cylindrical training cartridge insert having a central axial bore disposed within and completely enclosed by the cartridge case; and a training charge disposed within the axial bore of the insert.

According to the preferred embodiment of the invention the training cartridge insert is made of plastic, and the training charge fills the axial bore of the insert,the training cartridge insert extends from the closed bottom end of the cartridge case over a portion of the length of the cartridge case and has an outer surface with a diameter and shape so as to conform to the interior surface of the wall of the cartridge case, and means are provided for sealing both ends of the axial bore.

One embodiment of the invention is illustrated in the figure and will be described in greater detail with reference to this figure.

BRIEF DESCRIPTION OF THE DRAWING

The FIGURE illustrates a preferred embodiment of a training cartridge according to the invention.

DESCRIPTION OF THE PREFERRED EMBODIMENTS

As shown in the FIGURE, a training cartridge 10 has an essentially cylindrical cartridge case or shell 11 of metal, such as, e.g. brass, aluminum or steel, with an extraction groove 12 being worked into its outer circumference near the bottom 13 of the case 11. A percussion detonator insert 14 is provided in the bottom 13 of the case. Because of the reduction in cross section as a result of the extraction groove 12, the bottom region of cartridge case 11 is reinforced, i.e. given an increasing wall thickness.

The length of cartridge case 11 is adapted to the length of a combat cartridge. An essentially cylindrical insert 15, preferably made of plastic, is inserted into cartridge case 11 so as to terminate flush with the inner wall of the case. The insert 15 has a length between $\frac{2}{3}$ to $\frac{3}{4}$ of the length of the cartridge case 11. This length depends on the volume required for a training charge 17.

Insert 15 is provided with a central axial bore 16 of given diameter for receiving the training cartridge charge 17. The dimensions of bore 16 are such that the charge 17 completely fills bore 16. To prevent propelling charge powder of charge 17 from dropping or falling out, bore 16 is closed off and completely sealed. Depending on whether the bore 16 is a blind bore as shown or a through bore, the sealing may be achieved by means of an aluminum foil 18. Attached e.g., glued, onto one or both of the end surfaces of the insert 15.

To fix or secure the insert 15 in cartridge case 11, insert 15 is provided in its upper region opposite the case bottom 13, with a circumferential annular groove 19, which is positioned to be engaged by a rolled section 20, made externally on cartridge case 11, in a form-locking manner. Rolled section 20 may be provided at any desired location on the cartridge case 11. Preferably, the rolled section 20 is provided at the location where the belt claws of a cartridge supply belt grip the individual cartridge and thus fix the cartridge 10 against axial displacement. The cartridge which was originally completely cylindrical case 11, has a tip 21 region in its originally opening end. This tip region 21 is produced in a known manner by the folding or crimping of the open end of the cylindrical cartridge case. The small opening which remains at the end after the tip region 21 has been folded is sealed or soldered shut by means of an appropriate medium 22, such as, e.g., an adhesive, a plastic applied in liquid form, or a lacquer, so that an absolutely secure seal is ensured against the penetration of moisture into the cartridge.

The above-described training cartridge is manufactured easily and economically and is particularly suitable for mass production. Moreover, it is particularly suitable for use in automatic weapons firing at high cadences of, for example, 800 rounds per minute. Furthermore, it is suitable with weapons having high loading and ejection velocities wherein during loading and unloading of the weapon high stresses act on the training cartridge.

Insert 15 is preferably composed of injection molded plastic and is produced directly in its final dimensions without any additional processing steps. In this case, bore 16 is a blind bore as shown which is sealed with a thin plastic disc 23 on the side toward the case opening. The practice powder 17 required for the muzzle response effect is filled into the blind bore 16 and the bore is sealed with a glued-on aluminum foil 18. The plastic disc or cover 23 then bursts open when the shot is fired.

The injection molding process is extremely cost-effective and is therefore suitable for mass production.

However, insert 15 may also be made of an extruded plastic material, in which case the through bore 16 (or hole, recess, cavity, respectively) is shaped directly in the extruded piece during the extrusion process (e.g., by means of an appropriate nozzle having a central axial mandrel). With this method, the only processing steps required are the simple steps of cutting off the proper lengths, shaping the external annular groove 19, and reducing the cross-section at the end near the case bottom 13. This can be done on a lathe or grinding machine.

Next, the bore 16 of the insert 15 is filled with propelling charge powder and the insert 15 is glued shut on both sides with respective aluminum foils 18. Thus, no propelling charge powder can pour out when the insert 15 is handled during assembly. The insert 15 is placed into case 11 and fixed by rolled section 20, then the case opening is crimped and the tip 21 is sealed.

During firing, the gas pressure merely opens the crimping in the tip 21. The insert 15 (and possibly a weight equalizing piece) remains firmly fixed in the case so that no solid particles are ejected from the muzzle of the weapon. This eliminates any possibility of danger to exercising or drilling soldiers.

It will be understood that the above description of the present invention is susceptible to various modifications, changes and adaptations, and the same are intended to be comprehended within the meaning and range of equivalents of the appended claims.

What is claimed is:

1. A training cartridge comprising:

an essentially cylindrical relatively thin-walled metal cartridge case having a front end and an ogival tip, a closed bottom end having a detonator, and having a relatively thick-walled, essentially cylindrical training cartridge insert having a central axial bore having a predetermined diameter disposed within and completely enclosed by said cartridge case; said training cartridge insert extending from the closed bottom end of said cartridge case over a predetermined portion of the length of said cartridge case and having an outer surface with a diameter and shape which conforms to the interior surface of the wall of said cartridge case and substantially fills the interior region of said cartridge case throughout said predetermined portion of the length of said cartridge case; and a training charge disposed within said axial bore of said insert, wherein said training charge substantially completely fills said bore in said training cartridge insert; and further comprising sealing means for sealing each respective end of said bore.

2. A training cartridge as defined in claim 1, wherein said training cartridge insert is made of plastic.

3. A training cartridge as defined in claim 1, wherein said training cartridge insert has a length between $\frac{2}{3}$ and $\frac{3}{4}$ of the length of said cartridge case.

4. A training cartridge as defined in claim 1, wherein said training cartridge insert has a front and a bottom region; and wherein said interior surface of said wall of said cartridge case has a decreasing diameter adjacent said bottom end of said cartridge case, and said diameter and shape of said outer surface of said training cartridge insert adjacent said bottom region have a corresponding decreasing diameter.

5. A training cartridge as defined in claim 1 further comprising means for securing said training cartridge insert to said cartridge case.

6. A training cartridge as defined in claim 5, wherein said means for securing includes a circumferential annular groove formed in said outer surface of said training cartridge insert in its said front region, and a circumferential indented section formed in said wall of said cartridge case and engaging in said annular groove.

7. A training cartridge as defined in claim 1, wherein said sealing means includes a thin sheet of metal fastened to one end surface of said training cartridge insert.

8. A training cartridge as defined in claim 7, wherein said thin sheet of metal is an aluminum foil.

9. A training cartridge as defined in claim 7, wherein said one end surface of said training cartridge insert is the end surface facing said bottom of said cartridge case.

10. A training cartridge as defined in claim 7, wherein: said bore is a blind bore which extends almost completely through said training cartridge insert leaving a thin disc of the insert adjacent an end surface thereof; and said sealing means includes said thin disc.

11. A training cartridge as defined in claim 10, wherein said training cartridge insert is made of plastic and said one end surface of said training cartridge insert is the end surface facing said bottom of said cartridge case.

12. A training cartridge as defined in claim 1, further comprising means for securing said training cartrigde insert to said cartridge case; wherein said front end of said cartridge case is folded or crimped to form said ogival tip; and wherein means are provided for sealing said tip.

13. A training cartridge as defined in claim 1, wherein:

said front end of said cartridge case is folded or crimped to form said ogival tip; and means are provided for sealing said tip.

* * * * *